US011344111B1

(12) United States Patent
Johnes

(10) Patent No.: US 11,344,111 B1
(45) Date of Patent: May 31, 2022

(54) POWERED BRUSHING ASSEMBLY

(71) Applicant: Tim Johnes, Alton, IL (US)

(72) Inventor: Tim Johnes, Alton, IL (US)

( * ) Notice: Subject to any disclaimer, the term of this patent is extended or adjusted under 35 U.S.C. 154(b) by 0 days.

(21) Appl. No.: 17/209,847

(22) Filed: Mar. 23, 2021

(51) Int. Cl.
*A46B 13/02* (2006.01)

(52) U.S. Cl.
CPC ..... *A46B 13/02* (2013.01); *A46B 2200/3033* (2013.01)

(58) Field of Classification Search
None
See application file for complete search history.

(56) References Cited

U.S. PATENT DOCUMENTS 3,231,917 A * 2/1966 Reed ..... A47L 11/4069 15/98
4,005,502 A * 2/1977 Stevens (Boyer) .... A46B 13/02 15/22.1
5,186,627 A * 2/1993 Amit ..... A46B 7/06 134/6
5,950,268 A 9/1999 Murphy
7,213,289 B2 5/2007 Jaffe
7,743,683 B2 6/2010 Dayton
2003/0226223 A1* 12/2003 Chan ..... A61C 17/222 15/22.2
2004/0221405 A1 11/2004 Manfredi
2008/0115304 A1* 5/2008 Phipps ..... A46B 13/02 15/160
2016/0151689 A1* 6/2016 Wong ..... A46B 13/023 15/22.1
2020/0054123 A1* 2/2020 Franklin ..... H01M 10/0525
2021/0204668 A1* 7/2021 To ..... A46D 1/0238

FOREIGN PATENT DOCUMENTS

KR 20140107764 A * 9/2014

* cited by examiner

*Primary Examiner* — Joseph J Hail
*Assistant Examiner* — Dana Lee Poon

(57) ABSTRACT

A powered brushing assembly for scrubbing and cleaning surfaces includes a housing, which defines an interior space. A scrubber is engaged to the housing. A battery and an actuator are engaged to the housing and are positioned in the interior space. The actuator is operationally engaged to the battery and the scrubber. The battery is positioned to selectively power the actuator to oscillate the scrubber. The scrubber can be used to scrub a surface with less effort being required than would be required to scrub the surface with a nonpowered brushing assembly.

7 Claims, 6 Drawing Sheets

POWERED BRUSHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to brushing assemblies and more particularly pertains to a new brushing assembly for scrubbing and cleaning surfaces. The present invention discloses a brushing assembly that looks like a common cleaning brush, but which is powered to impart linear motion to the bristles.

(2) Description of Related Art Including Information Disclosed Under 37 CFR 1.97 and 1.98

The prior art relates to brushing assemblies. Prior art brushing assemblies may comprise hand-held powered scrubbing brushes, which generally have rotary motion of bristles of the brushes. What is lacking in the prior art is a brushing assembly that looks like a common cleaning brush, but which is powered to impart linear motion to the bristles.

BRIEF SUMMARY OF THE INVENTION

An embodiment of the disclosure meets the needs presented above by generally comprising a housing, which defines an interior space. A scrubber is engaged to the housing. A battery and an actuator are engaged to the housing and are positioned in the interior space. The actuator is operationally engaged to the battery and the scrubber. The battery is positioned to selectively power the actuator to oscillate the scrubber. The scrubber thus is configured to scrub a surface, with less effort being required than would be required to scrub the surface with a nonpowered brushing assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
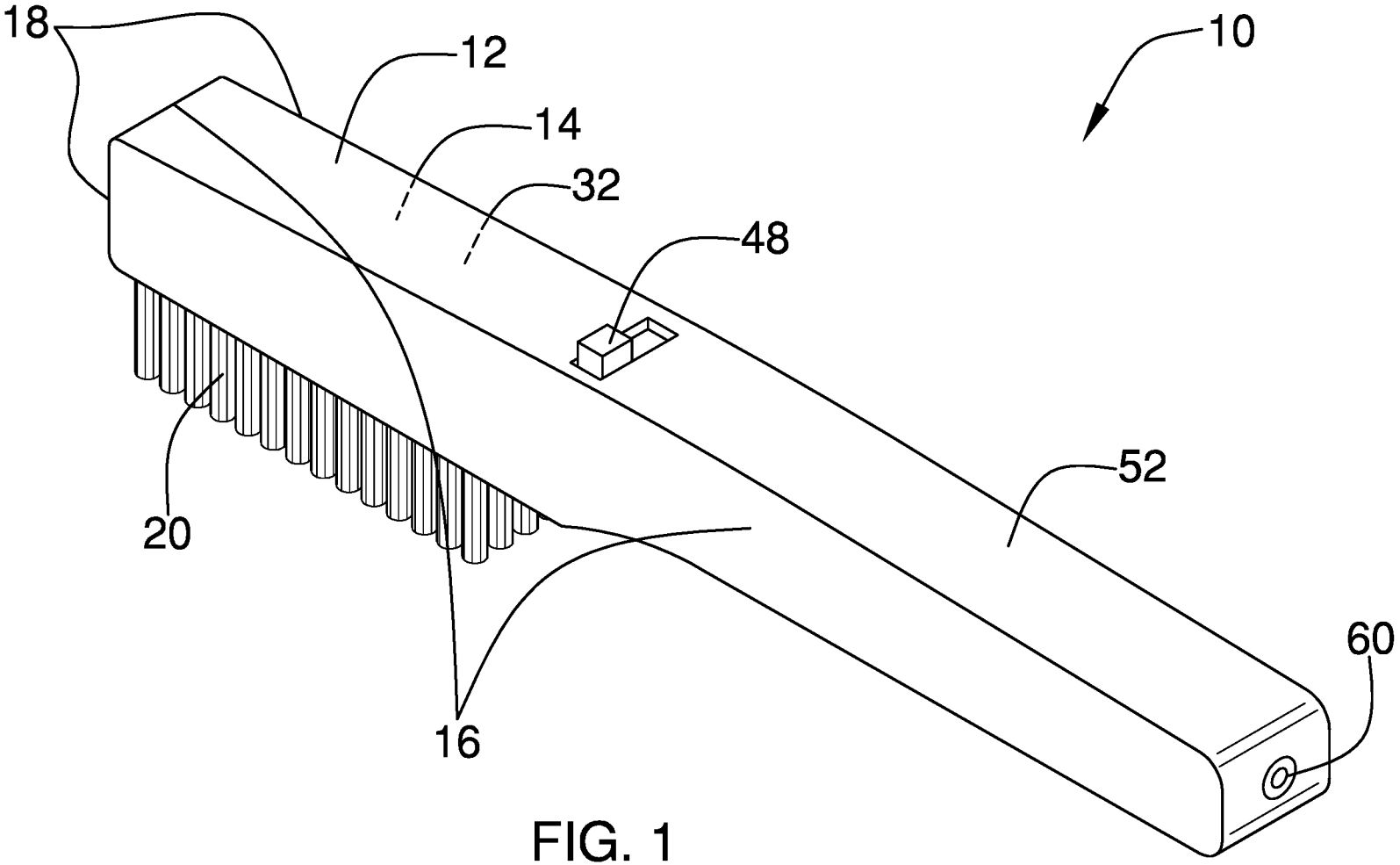
FIG. 1 is a top isometric perspective view of a powered brushing assembly according to an embodiment of the disclosure.

With reference now to the drawings, and in particular to FIGS. 1 through 9 thereof, a new brushing assembly embodying the principles and concepts of an embodiment of the disclosure and generally designated by the reference numeral 10 will be described.

Figure 2:
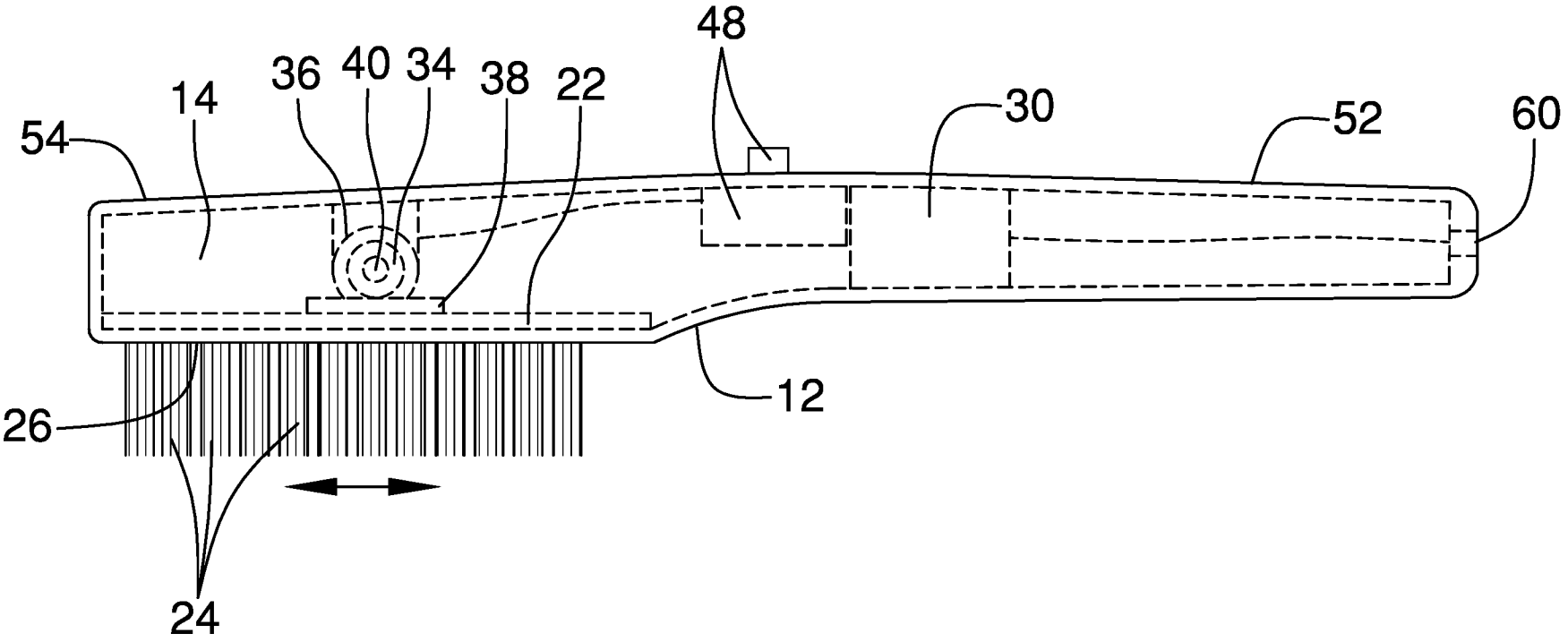
FIG. 2 is a side view of an embodiment of the disclosure.
Figure 3:
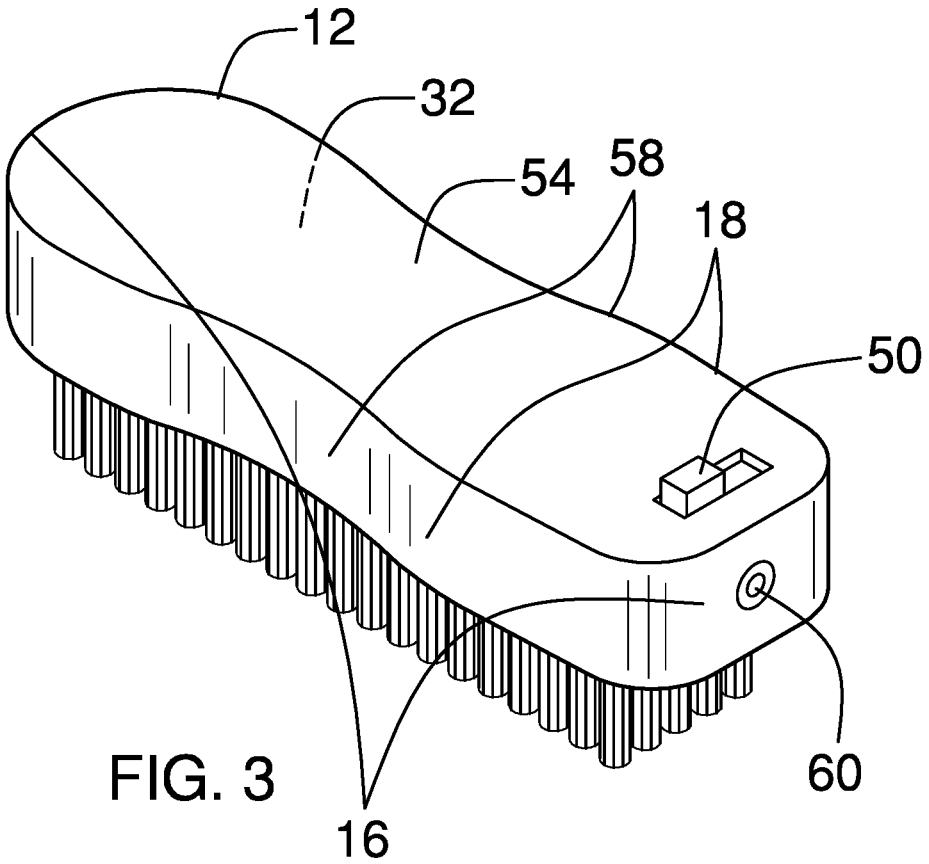
FIG. 3 is a top isometric perspective view of an embodiment of the disclosure.
Figure 6:
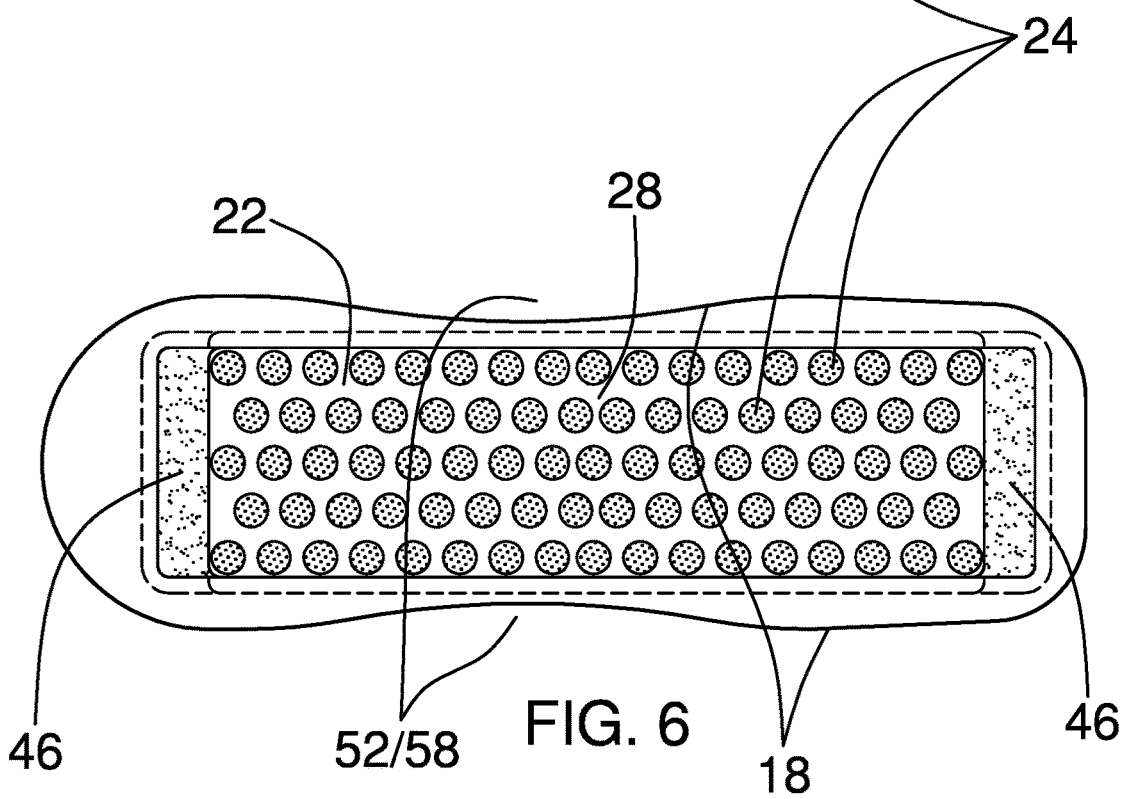
FIG. 6 is a bottom view of an embodiment of the disclosure.
Figure 7:
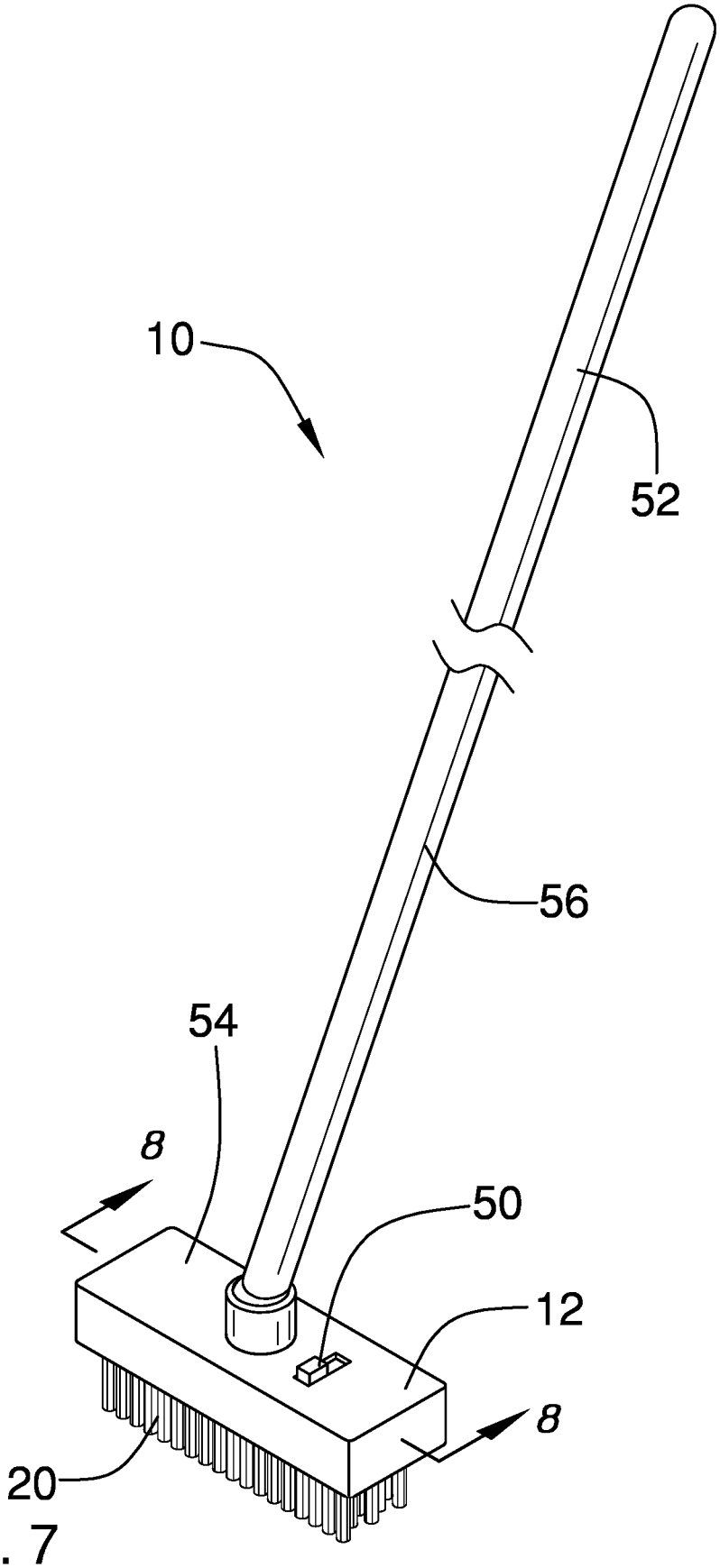
FIG. 7 is anisometric perspective view of an embodiment of the disclosure.

As best illustrated in FIGS. 1 through 9, the powered brushing assembly 10 generally comprises a housing 12, which defines an interior space 14. The housing 12 is substantially rectangularly box shaped. The housing 12 may be substantially elongated rectangularly box shaped, as shown in FIGS. 1, 3, and 7, so that opposed ends 16 of the housing 12 are dimensionally shorter than opposed sides 18 of the housing 12.

Figure 8:
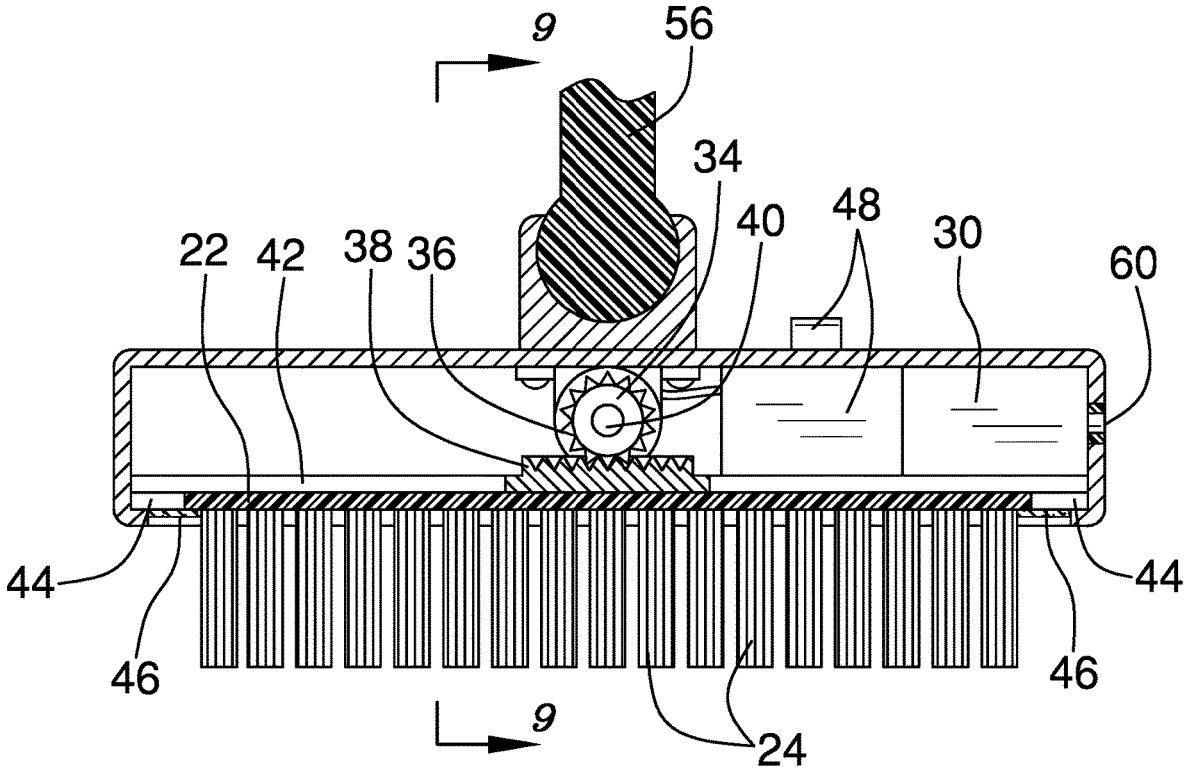
FIG. 8 is a cross-sectional view of an embodiment of the disclosure.

A scrubber 20 is engaged to the housing 12. The scrubber 20 comprises a plate 22 and a plurality of bristles 24. The plate 22 positioned in the interior space 14 proximate to a bottom 26 of the housing 12. The plate 22 is slidably engaged to the housing 12. The plate 22 is sized to extend substantially between either one of the opposed sides 18 or the opposed ends 16 of the housing 12. The plate 22 extends from proximate to the other of the opposed sides 18 or the opposed ends 16 and thus is positioned to slide between the opposed ends 16 or the opposed sides 18, respectively. As shown in FIGS. 2, 6, and 8, the plate 22 is sized to extend substantially between the opposed sides 18 and from proximate to the opposed ends 16. The plate 22 thus is positioned to slide between the opposed ends 16.

The plurality of bristles 24 is engaged to and extends from the plate 22 through a cutout 28 positioned in the bottom 26 of the housing 12. The plate 22 is dimensionally shorter than the cutout 28. The bristles 24 comprise synthetic polymer or metal wire. The bristles 24 comprise polyamide, steel, or brass.

A battery 30 and an actuator 32 are engaged to the housing 12 and are positioned in the interior space 14. The actuator 32 is operationally engaged to the battery 30 and the scrubber 20. The battery 30 is positioned to selectively power the actuator 32 to oscillate the scrubber 20. The scrubber 20 thus is configured to scrub a surface with less effort being required than would be required to scrub the surface with a nonpowered brushing assembly.

Figure 9:
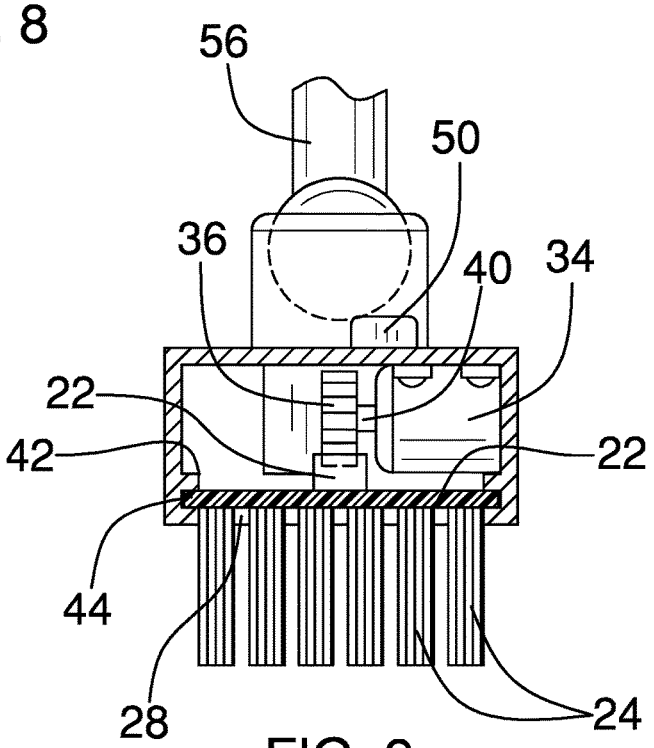
FIG. 9 is a cross-sectional view of an embodiment of the disclosure.

The actuator 32 comprises a motor 34, a pinion gear 36, and a rack gear 38. As shown in FIGS. 2, 8, and 9, the motor 34 is engaged to a respective opposed side 18 the housing 12 so that a shaft 40 of the motor 34 is perpendicular to the respective opposed side 18. The pinion gear 36 is engaged to the shaft 40 of the motor 34. The rack gear 38 is engaged to the plate 22 and is gearedly engaged to the pinion gear 36. The present invention also anticipates the actuator 32 comprising other actuating means, such as, but not limited to, a linear actuator engaged to the plate 22 and to a respective opposed end 16 of the housing 12.

Each of a pair of rails 42 is engaged to a respective opposed side 18 of the housing 12 and extends between the opposed ends 16. Each rail 42 defines a respective slot 44. The plate 22 is positioned in the slots 44 and thus is slidably engaged to the housing 12.

A pair of strips 46 is engaged singly to the opposed ends 16 of the housing 12 proximate to the bottom 26, as shown in FIGS. 6 and 8. The strips 46 extends from the opposed ends 16 into the cutout 28. The strips 46 comprise one or more of rubber, silicone, or elastomer so that the strips are resiliently flexible. The strips 46 are positioned to seal the cutout 28 as the plate 22 slides between the opposed ends 16.

A switch 48 is engaged to the housing 12 and is operationally engaged to the actuator 32 and the battery 30. The switch 48 is configured to be switched to engage the actuator 32 selectively and operationally to the battery 30. The switch 48 may comprise a slide 50, as shown in FIG. 1, or other switching means, such as, but not limited to, toggles, buttons, and the like.

The assembly 10 also comprises a handle 52. As shown in FIGS. 7-9, the handle 52 is engaged to and extends from a top 54 of the housing 12 and comprises a pole 56. The pole 56 is pivotally engaged to and extends from the top 54 so that the housing 12 can be motivated across a surface distal from the user. As shown in FIGS. 1 and 2, the handle 52 is engaged to and extends from a respective opposed end 16 of the housing 12. The handle 52 is configured to be grasped in a hand of user, positioning the user to motivate the housing 12 across the surface.

As shown in FIGS. 3-6, the handle 52 also may comprise a pair of recesses 58 extending singly into the opposed sides 18 of the housing 12. The recesses 58 configure the housing 12 to be grasped in a hand of user, positioning the user to motivate the housing 12 across the surface.

Figure 4:
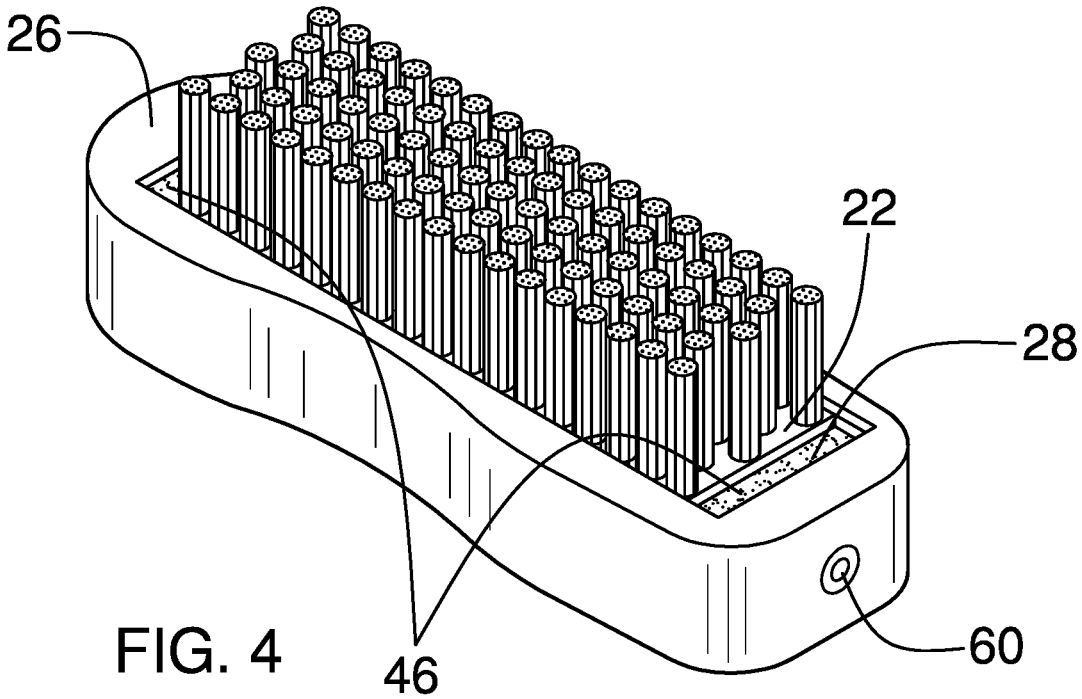
FIG. 4 is a bottom isometric perspective view of an embodiment of the disclosure.
Figure 5:
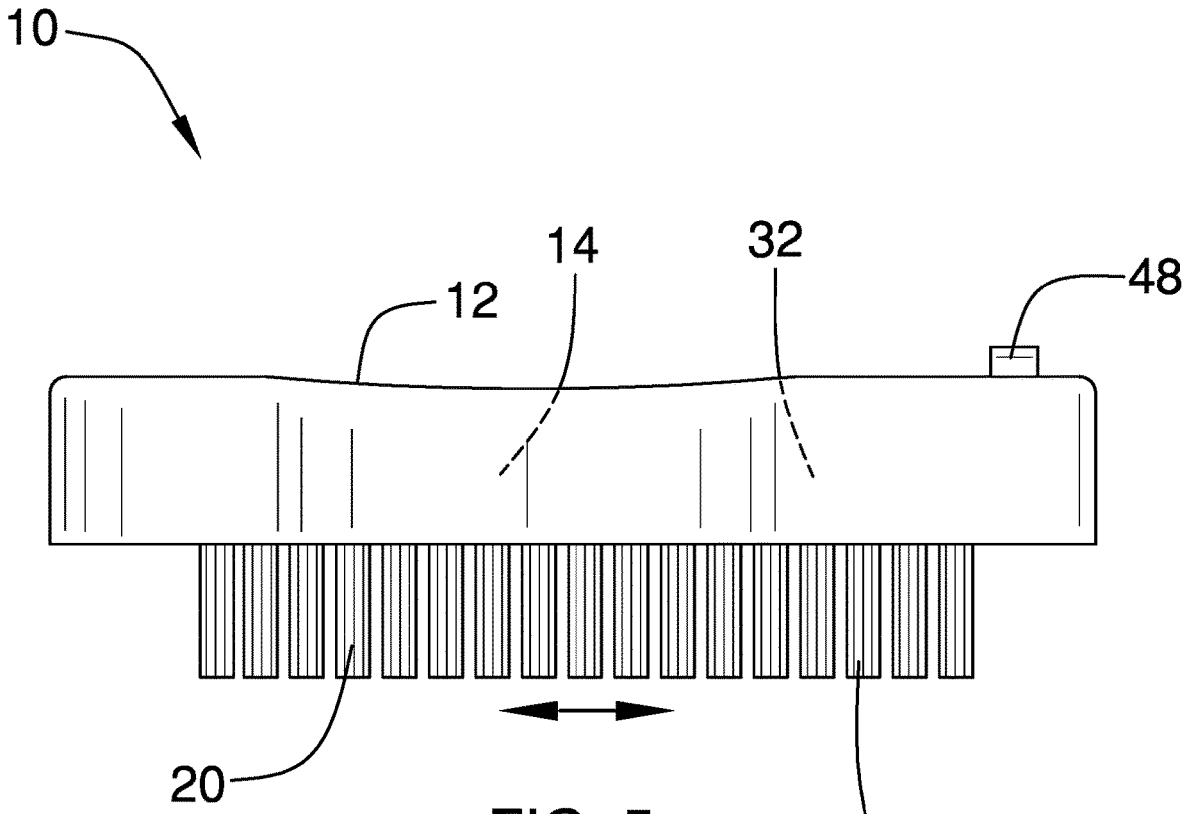
FIG. 5 is a side view of an embodiment of the disclosure.

The battery 30 is rechargeable. A port 60 is engaged to one of the housing 12, as shown in FIGS. 4 and 8, and the handle 52, as shown in FIG. 1. The port 60 is operationally engaged to the battery 30. The port 60 is configured for insertion of a plug of a charging cord (not shown) to operationally engage the battery 30 to a source of electrical current to charge the battery 30.

In use, the housing 12 is positioned so that the bristles 24 of the scrubber 20 contact a surface requiring cleaning. The switch 48 is switched to turn on the motor 34. The motor 34 induces the plate 22 to oscillate between the opposed ends 16 of the housing 12, which reciprocates the bristles 24 in a linear manner relative to the opposed ends 16 of the housing 12. The handle 52 then is used to motivate the housing 12 across the surface to clean it.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A powered brushing assembly comprising:

a housing defining an interior space, the housing being substantially elongated rectangularly box shaped, such that the opposed ends of the housing are dimensionally shorter than the opposed sides of the housing;

a scrubber engaged to the housing, the scrubber comprising a plate positioned in the interior space proximate to a bottom of the housing, the plate being slidably engaged to the housing, the plate being sized such that the plate extends substantially between either one of opposed sides or opposed ends of the housing, and such that the plate extends from proximate to the other of the opposed sides or the opposed ends, such that the plate is positioned for sliding between the opposed ends or the opposed sides, respectively, the plate being sized such that the plate extends substantially between the opposed sides and from proximate to the opposed ends, such that the plate is positioned for sliding between the opposed ends, and a plurality of bristles engaged to and extending from the plate through a cutout positioned in the bottom of the housing, the plate being dimensionally shorter than the cutout;

a battery engaged to the housing and positioned in the interior space;

an actuator engaged to the housing and positioned in the interior space, the actuator being operationally engaged to the battery and the scrubber, such that the battery is positioned for selectively powering the actuator for oscillating the scrubber, wherein the scrubber is configured for scrubbing a surface, the actuator comprising a motor, the motor being engaged to a respective opposed side of the housing such that a shaft of the motor is perpendicular to the respective opposed side, a pinion gear engaged to a shaft of the motor, and a rack gear engaged to the plate and being gearedly engaged to the pinion gear;

a pair of rails, each rail being engaged to a respective opposed side of the housing and extending between the opposed ends, such that each rail defines a respective slot, the plate being positioned in the slots, such that the plate is slidably engaged to the housing; and a pair of strips engaged singly to the opposed ends of the housing proximate to the bottom, the strips extending from the opposed ends into the cutout, the strips comprising one or more of rubber, silicone, or elastomer, such that the strips are resiliently flexible, such that the strips are positioned for sealing the cutout as the plate slides between the opposed ends.

2. The powered brushing assembly of claim 1, wherein the bristles comprise synthetic polymer or metal wire.

3. The powered brushing assembly of claim 2, wherein the bristles comprise polyamide, steel, or brass.

4. The powered brushing assembly of claim 1, further including a switch engaged to the housing and being operationally engaged to the actuator and the battery, wherein the switch is configured for being switched for selectively operationally engaging the actuator to the battery.

5. The powered brushing assembly of claim 1, further including a handle, the handle being engaged to and extending from the housing wherein the handle is configured for grasping in a hand of user, positioning the user tier motivating the housing across the surface.

6. The powered brushing assembly of claim 1, further including:

the battery being rechargeable; and a port engaged to one of the housing and the handle, the port being operationally engaged to the battery, wherein the port is configured for insertion of a plug of a charging cord for operationally engaging the battery to a source of electrical current for charging the battery.

7. A powered brushing assembly comprising:

a housing defining an interior space, the housing being substantially rectangularly box shaped, the housing being substantially elongated rectangularly box shaped, such that opposed ends of the housing are dimensionally shorter than opposed sides of the housing;

a scrubber engaged to the housing, the scrubber comprising:

a plate positioned in the interior space proximate to a bottom of the housing, the plate being slidably engaged to the housing, the plate being sized such that the plate extends substantially between the opposed sides and from proximate to the opposed ends, such that the plate is positioned for sliding between the opposed ends, and a plurality of bristles engaged to and extending from the plate through a cutout positioned in the bottom of the housing, the plate being dimensionally shorter than the cutout, the bristles comprising synthetic polymer or metal wire, the bristles comprising polyamide, steel, or brass;

a pair of rails, each rail being engaged to a respective opposed side of the housing and extending between the opposed ends, such that each rail defines a respective slot, the plate being positioned in the slots, such that the plate is slidably engaged to the housing;

a pair of strips engaged singly to the opposed ends of the housing proximate to the bottom, the strips extending from the opposed ends into the cutout, the strips comprising one or more of rubber, silicone, or elastomer, such that the strips are resiliently flexible, such that the strips are positioned for sealing the cutout as the plate slides between the opposed ends;

a battery engaged to the housing and positioned in the interior space, the battery being rechargeable;

an actuator engaged to the housing and positioned in the interior space, the actuator being operationally engaged to the battery and the scrubber, such that the battery is positioned for selectively powering the actuator for oscillating the scrubber, wherein the scrubber is configured for scrubbing a surface, the actuator comprising:

a motor, the motor being engaged to a respective opposed side the housing such that a shaft of the motor is perpendicular to the respective opposed side, a pinion gear engaged to a shaft of the motor, and a rack gear engaged to the plate and being gearedly engaged to the pinion gear;

a switch engaged to the housing and being operationally engaged to the actuator and the battery, wherein the switch is configured for being switched for selectively operationally engaging the actuator to the battery;

a handle, the handle being engaged to and extending from the housing, wherein the handle is configured for grasping in a hand of user, positioning the user fir motivating the housing across the surface; and a port engaged to one of the housing and the handle, the port being operationally engaged to the battery, wherein the port is configured for insertion of a plug of a charging cord for operationally engaging the battery to a source of electrical current for charging the battery.

* * * * *